US010641203B2

(12) United States Patent
Tateno

(10) Patent No.: US 10,641,203 B2
(45) Date of Patent: May 5, 2020

(54) WASTE HEAT RECOVERY APPARATUS AND METHOD FOR CONTROLLING WASTE HEAT RECOVERY APPARATUS

(71) Applicant: TOYOTA JIDOSHA KABUSHIKI KAISHA, Toyota-shi, Aichi-ken (JP)

(72) Inventor: Manabu Tateno, Shizuoka-ken (JP)

(73) Assignee: TOYOTA JIDOSHA KABUSHIKI KAISHA, Toyota-shi, Aichi-ken (JP)

( * ) Notice: Subject to any disclaimer, the term of this patent is extended or adjusted under 35 U.S.C. 154(b) by 112 days.

(21) Appl. No.: 15/922,098

(22) Filed: Mar. 15, 2018

(65) Prior Publication Data

US 2018/0266360 A1 Sep. 20, 2018

(30) Foreign Application Priority Data

Mar. 17, 2017 (JP) ..... 2017-052938

(51) Int. Cl.

| | |
|---|---|
| ***F02G 5/04*** | (2006.01) |
| ***F01K 13/02*** | (2006.01) |
| ***F01D 15/08*** | (2006.01) |
| ***F01K 23/10*** | (2006.01) |

(Continued)

(52) U.S. Cl.

CPC ..... *F02G 5/04* (2013.01); *F01D 15/08* (2013.01); *F01K 13/02* (2013.01); *F01K 23/065* (2013.01); *F01K 23/101* (2013.01); *F01P 7/162* (2013.01); *F01P 2050/24* (2013.01); *F02G 2260/00* (2013.01)

(58) Field of Classification Search

CPC ..... F02G 5/04; F01K 13/02; F01K 23/101; F01D 15/08; F02D 2260/00; F01P 2050/24; F01P 7/162

See application file for complete search history.

(56) References Cited

U.S. PATENT DOCUMENTS 5,611,673 A * 3/1997 Agata ..... F04F 5/462 239/433
2004/0060292 A1* 4/2004 Minemi ..... F01B 17/04 60/616

(Continued)

FOREIGN PATENT DOCUMENTS

JP 49-11353 U 4/1972
JP 2006250075 A * 9/2006 ..... F01K 23/101

(Continued)

OTHER PUBLICATIONS

English Translation of Communication dated Aug. 6, 2019, from the Japanese Patent Office in counterpart application No. 2017-052938.

*Primary Examiner* — Patrick D Maines
(74) *Attorney, Agent, or Firm* — Sughrue Mion, PLLC

(57) ABSTRACT

A waste heat recovery apparatus includes an evaporator, an expander, a condenser, a liquid-phase refrigerant supply device, and a control device. The control device is configured to control the liquid-phase refrigerant supply device so as to bring the supply of the liquid-phase refrigerant by the liquid-phase refrigerant supply device into a stopped state at least until an amount of the liquid-phase refrigerant stored in the evaporator becomes equal to or lower than a predetermined low refrigerant amount, during operation of the internal combustion engine.

9 Claims, 8 Drawing Sheets

(51) Int. Cl.
*F01P 7/16* (2006.01)
*F01K 23/06* (2006.01)

(56) References Cited

U.S. PATENT DOCUMENTS

| | | | | |
|---|---|---|---|---|
| 2005/0072185 | A1* | 4/2005 | Taniguchi ..... | B01D 5/0093 62/475 |
| 2006/0254276 | A1 | 11/2006 | Sato et al. | |
| 2007/0187071 | A1 | 8/2007 | Miyagawa et al. | |

FOREIGN PATENT DOCUMENTS

| | | | | |
|---|---|---|---|---|
| JP | 2007-212075 | A | | 8/2007 |
| JP | 2010-127138 | A | | 6/2010 |
| JP | 2012-102644 | A | | 5/2012 |
| JP | 2013-119831 | A | | 6/2013 |
| JP | 2014134174 | A | * | 7/2014 |
| JP | 2014134174 | A | | 7/2014 |
| JP | 2016-17487 | A | | 2/2016 |

* cited by examiner

WASTE HEAT RECOVERY APPARATUS AND METHOD FOR CONTROLLING WASTE HEAT RECOVERY APPARATUS

INCORPORATION BY REFERENCE

The disclosure of Japanese Patent Application No. 2017-052938 filed on Mar. 17, 2017 including the specification, drawings and abstract is incorporated herein by reference in its entirety.

BACKGROUND

1. Technical Field

The present disclosure relates to a waste heat recovery apparatus and a method for controlling a waste heat recovery apparatus, and particularly, to a waste heat recovery apparatus and a method for controlling a waste heat recovery apparatus that recovers the waste heat of an internal combustion engine by using a Rankine cycle system.

2. Description of Related Art

Japanese Unexamined Patent Application Publication No. 2013-119831 (JP 2013-119831 A) discloses a technique regarding a power recovery apparatus including a Rankine cycle device constituted of a pump, a boiler, an expander, and a condenser. The pump pumps a refrigerant to the boiler side. The boiler causes the refrigerant pumped by the pump to perform heat exchange with exhaust gas flowing through an exhaust pipe of an engine so as to heat the refrigerant. The refrigerant turned into steam by being heated by the boiler flows into the expander. The expander takes out the expansion energy of the refrigerant turned into steam by the boiler as power to rotate a drive shaft.

In the power recovery apparatus, the pumping speed of the refrigerant by the pump is controlled in accordance with the rotating speed of the engine. Specifically, when the rotating speed of the engine exceeds a predetermined rotating speed, the rotating speed of the pump is controlled such that the pumping speed of the refrigerant by the pump decreases. Accordingly, the expander is restrained from overspeeding.

SUMMARY

In the technique of JP 2013-119831 A, the amount of the refrigerant to be pumped by the evaporator is controlled for the purpose of restraining the overspeed of the expander. However, the supply of the refrigerant to the evaporator also influences the temperature of the refrigerant within the evaporator. That is, a boiling refrigerant is stored in the evaporator under heating. For this reason, when the refrigerant that does not reach a boiling temperature is frequently pumped to the evaporator, a refrigerant temperature within the evaporator may drop and boiling may subside temporarily. In this case, since the amount of a gas-phase refrigerant turned into steam decreases, there is a problem in that that the waste heat recovery efficiency of the Rankine cycle will incline.

The present disclosure provides a waste heat recovery apparatus and a method for controlling a waste heat recovery apparatus that can continue boiling of a refrigerant stored in an evaporator as long as possible to enhance waste heat recovery efficiency.

A first aspect of the present disclosure relates to a waste heat recovery apparatus including an evaporator configured to turn a liquid-phase refrigerant into steam through heat exchange with exhaust gas of an internal combustion engine, an expander configured to expand a gas-phase refrigerant passed through the evaporator to recover heat energy, a condenser configured to condense the gas-phase refrigerant passed through the expander such that the gas-phase refrigerant returns to the liquid-phase refrigerant, a liquid-phase refrigerant supply device configured to supply the liquid-phase refrigerant delivered from the condenser, to the evaporator, and a control device configured to control the liquid-phase refrigerant supply device so as to adjust an amount of the liquid-phase refrigerant to be supplied to the evaporator. The control device is configured to control the liquid-phase refrigerant supply device so as to bring the supply of the liquid-phase refrigerant by the liquid-phase refrigerant supply device into a stopped state at least until an amount of the liquid-phase refrigerant stored in the evaporator becomes equal to or lower than a predetermined low refrigerant amount, during operation of the internal combustion engine.

In the first aspect of the present disclosure, the liquid-phase refrigerant supply device may be a pump that pumps the liquid-phase refrigerant delivered from the condenser to the evaporator, and the control device may be configured to stop operation of the pump when the supply of the liquid-phase refrigerant is brought into a stopped state.

In the first aspect of the present disclosure, the control device may be configured to continue a state where the operation of the pump is stopped, during the operation of the internal combustion engine and even after the amount of the liquid-phase refrigerant stored in the evaporator becomes equal to or lower than the low refrigerant amount.

In the first aspect of the present disclosure, the control device may be configured to operate the pump during the operation of the internal combustion engine and in a case where the amount of the liquid-phase refrigerant stored in the evaporator becomes equal to or lower than the low refrigerant amount.

In the first aspect of the present disclosure, the control device may be configured to operate the pump during stop of the internal combustion engine and in a case where a temperature of the liquid-phase refrigerant stored in the evaporator reaches a boiling temperature; and the control device may be configured to bring the pump into a stopped state during the stop of the internal combustion engine and when the temperature of the liquid-phase refrigerant stored in the evaporator does not reach the boiling temperature.

In the first aspect of the present disclosure, the control device may be configured to calculate an amount of a refrigerant needed to bring the amount of the liquid-phase refrigerant stored in the evaporator into a full amount as a target refrigerant amount, and the control device may be configured to control the operation of the pump with the target refrigerant amount as an upper limit.

The waste heat recovery apparatus of the first aspect of the present disclosure may further include a heat recovery device that performs heat exchange between the liquid-phase refrigerant passed through the pump, and an engine coolant passed through the internal combustion engine, and a pumping device that pumps the engine coolant to the heat recovery device. The control device may be configured to operate the pumping device in a case where the pump is operated and in a case where a temperature of the engine coolant passed through the pump is higher than a temperature of the liquid-phase refrigerant.

In the first aspect of the present disclosure, the evaporator may include a flue tube through which the exhaust gas of the internal combustion engine flows and a refrigerant passage which is formed around the flue tube and in which the liquid-phase refrigerant is stored, a first end of the flue tube may be constituted as a fixed end; and a second end of the flue tube may include a bellows tube for absorbing a change in tube length resulting from thermal expansion of the flue tube.

A second aspect of the present disclosure related to a method for controlling a waste heat recovery apparatus. The waste heat recovery apparatus includes an evaporator, an expander, a condenser, and a liquid-phase refrigerant supply device. The evaporator is configured to turn a liquid-phase refrigerant into steam through heat exchange with exhaust gas of an internal combustion engine. The expander is configured to expand a gas-phase refrigerant passed through the evaporator to recover heat energy. The condenser is configured to condense the gas-phase refrigerant passed through the expander to return the condensed gas-phase refrigerant to the liquid-phase refrigerant. The liquid-phase refrigerant supply device is configured to supply the liquid-phase refrigerant delivered from the condenser, to the evaporator. The method includes adjusting an amount of the liquid-phase refrigerant to be supplied to the evaporator by controlling the liquid-phase refrigerant supply device; receiving operation of the internal combustion engine to bring the supply of the liquid-phase refrigerant by the liquid-phase refrigerant supply device into a stopped state; and continuing the stopped state until an amount of the liquid-phase refrigerant stored in the evaporator becomes equal to or lower than a predetermined low refrigerant amount during the operation of the internal combustion engine.

During the operation of the internal combustion engine, the liquid-phase refrigerant stored in the evaporator is heated and boils through the heat exchange between the exhaust gas of the internal combustion engine and the liquid-phase refrigerant. According to the first and second aspects of the present disclosure, during the operation of the internal combustion engine, the liquid-phase refrigerant is not supplied to the evaporator until the liquid-phase refrigerant stored in the evaporator becomes equal to or lower than the predetermined low refrigerant amount. Accordingly, since the boiling of the liquid-phase refrigerant stored in the evaporator can be restrained from subsiding during the operation of the internal combustion engine, the waste heat recovery efficiency can be enhanced.

According to the first aspect of the present disclosure, it is possible to bring the supply of the liquid-phase refrigerant into a stopped state by stopping the operation of the pump that pumps the liquid-phase refrigerant delivered from the condenser, to the evaporator.

According to the first aspect of the present disclosure, the stopped state is continued even after the liquid-phase refrigerant stored in the evaporator becomes equal to or lower than the predetermined low refrigerant amount during the operation of the internal combustion engine. Accordingly, it is possible to continue the boiling state of the refrigerant until the liquid-phase refrigerant stored in the evaporator runs out.

According to the first aspect of the present disclosure, the liquid-phase refrigerant is pumped to the evaporator in a case where the liquid-phase refrigerant stored in the evaporator becomes equal to or lower than the predetermined low refrigerant amount during the operation of an internal combustion engine. Accordingly, a decline in the waste heat recovery efficiency that can occur due to the fact that the liquid-phase refrigerant stored in the evaporator has the low refrigerant amount can be suppressed.

According to the first aspect of the present disclosure, the pump is operated when the temperature of the liquid-phase refrigerant stored in the evaporator reaches the boiling temperature during the stop of the internal combustion engine, and the pump is brought into a stopped state when the temperature of the liquid-phase refrigerant does not reach the boiling temperature. Accordingly, since the temperature can be restrained from further dropping from a state where the liquid-phase refrigerant stored in the evaporator does not boil, the time needed until the refrigerant boils after the next operation of the internal combustion engine can be prolonged to restrain the waste heat recovery efficiency from declining.

According to the first aspect of the present disclosure, in a case where the conditions for operating the pump are satisfied, it is possible to pump the liquid-phase refrigerant to the evaporator with the full amount as the upper limit.

According to the first aspect of the present disclosure, the liquid-phase refrigerant pumped to the evaporator can be heated through the heat exchange with the engine coolant. Therefore, a higher-temperature liquid-phase refrigerant can be pumped to the evaporator. Accordingly, since the time until the liquid-phase refrigerant of the evaporator boils can be shortened, the waste heat recovery efficiency can be enhanced.

According to the first aspect of the present disclosure, the evaporator includes a structure for absorbing a change in tube length resulting from the thermal expansion of the flue tube. Accordingly, since the heat resistance of the evaporator can be enhanced, occurrence of a problem caused by the amount of the liquid-phase refrigerant decreasing and the evaporator being excessively superheated can be restrained.

BRIEF DESCRIPTION OF THE DRAWINGS

Features, advantages, and technical and industrial significance of exemplary embodiments of the present disclosure will be described below with reference to the accompanying drawings, in which like numerals denote like elements, and wherein.

DETAILED DESCRIPTION OF EMBODIMENTS

Hereinafter, embodiments of the present disclosure will be described with reference to the drawings. It is to be noted, however, that common elements in the respective drawings will be designated by the same reference signs, and the duplicate description thereof will be omitted. However, except for cases where numbers, such as the numbers, quantities, amounts, and ranges of respective elements, are mentioned in the embodiments shown below, and particularly, cases where the numbers, such as the numbers, quantities, amounts, and ranges of respective elements are explicitly stated or are clearly specified in principle, the present disclosure is not limited to the mentioned numbers. The structures and the like to be described in the embodiments shown below are not necessarily indispensable to the present disclosure except for cases where the structures and the like are explicitly stated or are clearly specified in principle.

Embodiment 1

1-1. Configuration of Waste Heat Recovery Apparatus

Figure 1:
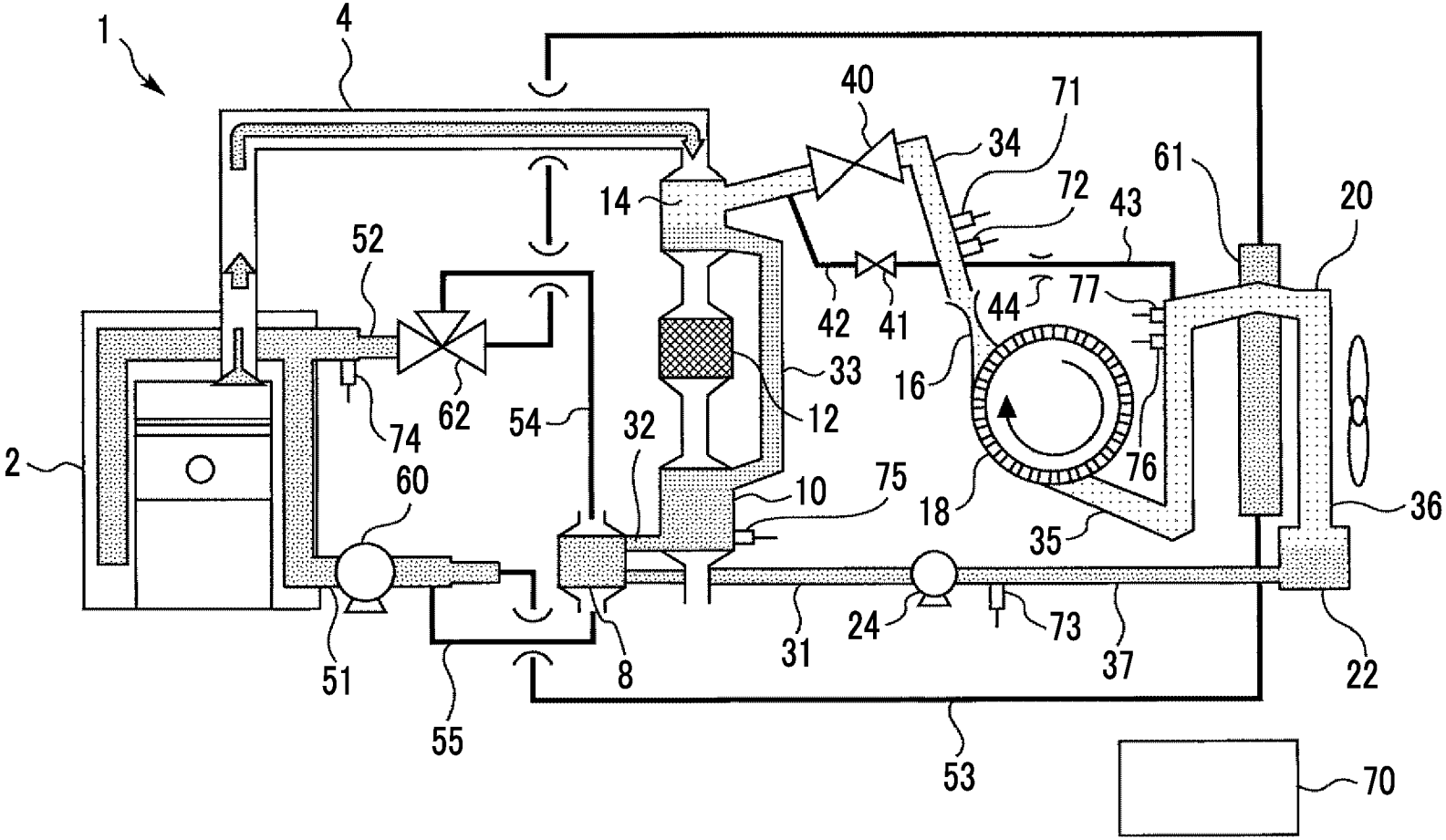
FIG. 1 is a view illustrating the configuration of a waste heat recovery apparatus of Embodiment 1.

FIG. 1 is a view illustrating the configuration of a waste heat recovery apparatus 1 of Embodiment 1. The waste heat recovery apparatus 1 is configured by being assembled into an internal combustion engine (hereinafter, also referred to as an "engine") 2 mounted on a vehicle. The vehicle is a hybrid vehicle using the power from the engine 2 and the power from a motor (not illustrated). The vehicle that is applicable to the waste heat recovery apparatus 1 of Embodiment 1 is not limited to the hybrid vehicle and may be applied to various vehicles, such as a start-stop vehicle having a start-stop function, on the premise that the engine 2 is frequently operated and stopped.

The waste heat recovery apparatus 1 includes a refrigerant circulation circuit in which a plurality of refrigerant pipes 31, 32, 33, 34, 35, 36, 37 is provided such that the refrigerant pipes are annularly connected together. A pump 24 serving as a liquid-phase refrigerant supply device, which delivers a liquid-phase refrigerant from the refrigerant pipe 37 to the refrigerant pipe 31, is disposed in the refrigerant circulation circuit. The waste heat recovery apparatus 1 performs heat exchange between exhaust gas flowing through an exhaust passage 4 of the engine 2, and the refrigerant circulating through the refrigerant circulation circuit, and thereby the waste heat of the exhaust gas is transferred to the refrigerant. The refrigerant is liquid at normal temperature, and may be anything that boils or evaporates due to the heat of the engine 2 and turns into a gas-phase refrigerant. In the present embodiment, the refrigerant is water.

An evaporator 10, which is a heat exchanger, an exhaust gas control catalyst 12, and a superheater 14 are attached to the exhaust passage 4 sequentially from a downstream side in a flow direction of the exhaust gas. An outlet of the pump 24 is connected to an engine cooling heat recovery device 8 by the refrigerant pipe 31. The engine cooling heat recovery device 8 performs heat exchange between an engine coolant passed through the engine 2, and the refrigerant circulating through the refrigerant circulation circuit, and thereby the waste heat of the engine coolant is transferred to the refrigerant. The engine cooling heat recovery device 8 is connected to the evaporator 10 by the refrigerant pipe 32. The evaporator 10 is connected to the superheater 14 by the refrigerant pipe 33. The water delivered from the pump 24 absorbs heat from the engine coolant in the engine cooling heat recovery device 8, and turns into high-temperature hot water. The hot water absorbs heat from high-temperature exhaust gas in the evaporator 10, evaporates or boils, and turns into steam. The steam further absorbs heat from high-temperature exhaust gas in the superheater 14, and turns into superheated steam.

The superheater 14 is connected to a turbine 18 by the refrigerant pipe 34. The turbine 18 functions as an expander that expands the steam delivered from the superheater 14 to take out work. A turbine nozzle 16 is provided at a connecting part between the refrigerant pipe 34 and the turbine 18. The steam is jetted to the turbine 18 from the turbine nozzle 16 to rotate the turbine 18. The rotation of the turbine 18 is transmitted to an output shaft of the engine 2 via a speed reducer (not illustrated). That is, the work taken out in the turbine 18 is used for assisting in the engine 2. It is to be noted, however, that it is possible to adopt a configuration in which a generator is driven by the turbine 18 and generated electricity is stored in a storage battery.

The turbine 18 is connected to a condenser 20 by the refrigerant pipe 35. The steam expanded in the turbine 18 is cooled and condensed by the condenser 20, and is returned to liquid-phase water. A catch tank 22 in which water is stored is disposed below the condenser 20 in a vertical direction. The condenser 20 is connected to the catch tank 22 by the refrigerant pipe 36. The water produced due to the condensation of the steam in the condenser 20 is temporarily stored in the catch tank 22. The catch tank 22 is connected to an inlet of the pump 24 by the refrigerant pipe 37. The water in the catch tank 22 is again delivered to the evaporator 10 by the pump 24. The pump 24 is a positive-displacement pump, such as a vane pump.

The waste heat recovery apparatus 1 includes a turbine control valve 40 provided in the refrigerant pipe 34. Additionally, the waste heat recovery apparatus 1 includes a bypass circuit that bypasses the turbine 18, and a bypass valve 41 provided in the bypass circuit. The bypass circuit is constituted of a refrigerant pipe 42 that branches from an upstream side of the turbine control valve 40 in the refrigerant pipe 34 and is connected to the bypass valve 41, and a refrigerant pipe 43 that connects the bypass valve 41 and the refrigerant pipe 35 together. The turbine control valve 40 and the bypass valve 41 are control valves that are operated depending on signals from a control device 70 to be described below. Additionally, the waste heat recovery apparatus 1 includes a bypass nozzle 44 in the refrigerant pipe 43.

The waste heat recovery apparatus 1 includes an engine coolant circulation circuit in which a plurality of fluid pipes 51, 52, 53 is provided such that the fluid pipes are annularly connected together. An engine cooling pump 60, which delivers the engine coolant from the fluid pipe 53 to the fluid pipe 51, is disposed in the engine coolant circulation circuit. An outlet of the engine cooling pump 60 is connected to an engine coolant inlet of the engine 2 by the fluid pipe 51. An engine coolant outlet of the engine 2 is connected to an inlet of a radiator 61 by the fluid pipe 52. The high-temperature engine coolant delivered from the engine 2 is cooled by the radiator 61. An outlet of the radiator 61 is connected to an inlet of the engine cooling pump 60 by the fluid pipe 53. The engine cooling pump 60 is an electric pump that is operated depending on a signal from the control device 70 to be described below.

The radiator 61 is disposed on a vehicle rear side with respect to the condenser 20. According to such an arrangement, a traveling wind is introduced into the radiator 61 after being first introduced into the condenser 20 to absorb the heat of the condenser. Thus, excessive cooling of the radiator 61 is suppressed in a case where the engine 2 is stopped and the vehicle travels.

The waste heat recovery apparatus 1 includes a radiator bypass circuit that bypasses the radiator 61 to circulate the engine coolant. A radiator bypass circuit is configured to include a fluid pipe 54 that branches from the fluid pipe 52 and is connected to the engine cooling heat recovery device 8, and a fluid pipe 55 that connects the engine cooling heat recovery device 8 and the fluid pipe 53 together. A three-way valve 62 is disposed at a connecting part between the fluid pipe 52 and the fluid pipe 54. The three-way valve 62 is a valve that switches a flow destination for the engine coolant, which flows through the fluid pipe 52, between the fluid pipe 53 and the fluid pipe 54, and is operated depending on a signal from the control device 70 to be described below.

In the waste heat recovery apparatus 1, a plurality of sensors is disposed in the middle of the refrigerant circulation circuit and the engine coolant circulation circuit. A pressure sensor 71 for detecting a pre-pressure (hereinafter, a nozzle pre-pressure) P of the turbine nozzle 16, and a temperature sensor 72 for detecting a pre-temperature (a nozzle pre-temperature) T of the turbine nozzle 16 are disposed in the refrigerant pipe 34. Additionally, a temperature sensor 73, which detects a refrigerant temperature (hereinafter, a pump inlet coolant temperature) on the inlet side of the pump 24, is disposed in the refrigerant pipe 37. Additionally, a temperature sensor 74, which detects the temperature (hereinafter, engine outlet coolant temperature) of the engine coolant passed through the engine 2, is disposed in the fluid pipe 52. Moreover, a temperature sensor 75, which detects the temperature of the liquid-phase water that is stored inside, is disposed in the evaporator 10. Moreover, a pressure sensor 76 for detecting a post-pressure (hereinafter, nozzle post-pressure) of the turbine nozzle 16, and a temperature sensor 77 for detecting a post-temperature (a nozzle post-temperature) of the turbine nozzle 16 are disposed in the refrigerant pipe 35.

The waste heat recovery apparatus 1 includes the control device 70. The control device 70 is a control device that totally controls the overall waste heat recovery apparatus 1. The control device 70 includes at least an input/output interface, a memory, and a CPU. The input/output interface is provided to fetch sensor signals from sensors attached to the waste heat recovery apparatus 1 and to output operation signals to various actuators provided in the waste heat recovery apparatus 1. The temperature sensors 72, 73, 74, 75, 77 and the pressure sensors 71 and 76 are included in the sensors from which the control device 70 fetches the signals. The pump 24, the engine cooling pump 60, the turbine control valve 40, the bypass valve 41, and the three-way valve 62 are included in the actuators from which the control device 70 issues the operation signals. Various control programs, maps, and the like for controlling the waste heat recovery apparatus 1 are stored in the memory. The CPU reads and executes the control programs or the like from the memory, and generates the operation signals based on the fetched sensor signals. Although many other actuators and sensors to be connected to the control device 70 in addition to those illustrated in the drawing are also present, the description thereof is omitted in this specification.

1-2. Configuration of Evaporator

Figure 2:
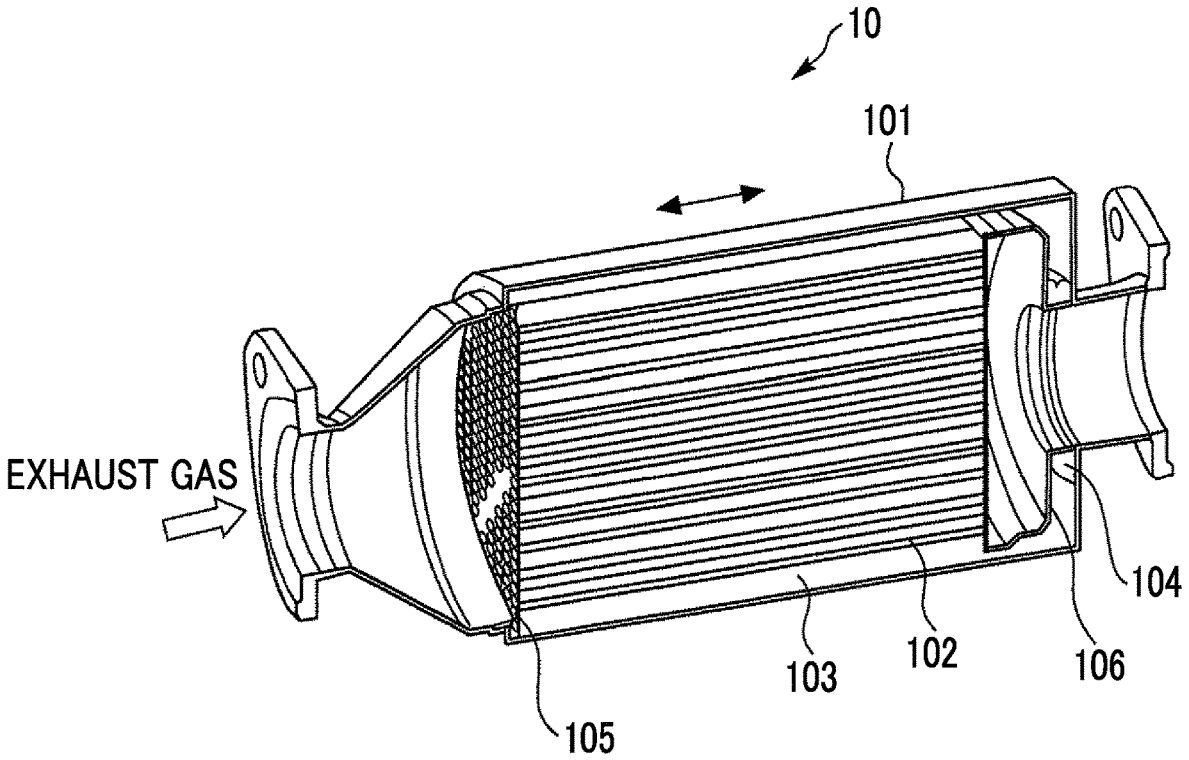
FIG. 2 is a view illustrating an internal configuration of an evaporator provided in the waste heat recovery apparatus of Embodiment 1.

When most of the refrigerant stored in the evaporator 10 undergoes a phase transition to the gas-phase refrigerant, the evaporator 10 will be superheated to a temperature equal to or higher than the boiling point of the refrigerant. In the waste heat recovery apparatus 1 of Embodiment 1, the evaporator 10 capable of withstanding such no-water burning is adopted. FIG. 2 is a view illustrating an internal configuration of the evaporator 10 provided in the waste heat recovery apparatus 1 of Embodiment 1. As illustrated in FIG. 2, the evaporator 10 includes a tubular housing 101, a flue tube 102 through which the exhaust gas flows, a refrigerant passage 103 in which the refrigerant is stored, and a bellows tube 104. The flue tube 102 is constituted of a plurality of tubes disposed in parallel within the housing 101, and is configured such that the exhaust gas flowing from the exhaust passage 4 passes through the tube. A space around the flue tube 102 inside the housing 101 is constituted as the refrigerant passage 103. The water pumped from the refrigerant pipe 32 is stored in the refrigerant passage 103.

A first end 105 of the flue tube 102 is a fixed end fixed to the housing 101. A second end 106 of the flue tube 102 is fixed to the housing 101 via the bellows tube 104. The bellows tube 104 is configured to be extendable in a longitudinal direction of the flue tube 102 in accordance with a change in tube length resulting from the thermal expansion of the flue tube 102. The evaporator 10 is made of a high heat-resistant material, such as stainless steel. In the waste heat recovery apparatus 1 of Embodiment 1, a control (to be described below) assuming a situation in which the evaporator 10 undergoes the no-water burning is realized by including the evaporator 10 configured as described above.

1-3. Waste Heat Recovery Control of Waste Heat Recovery Apparatus 1

Figure 3:
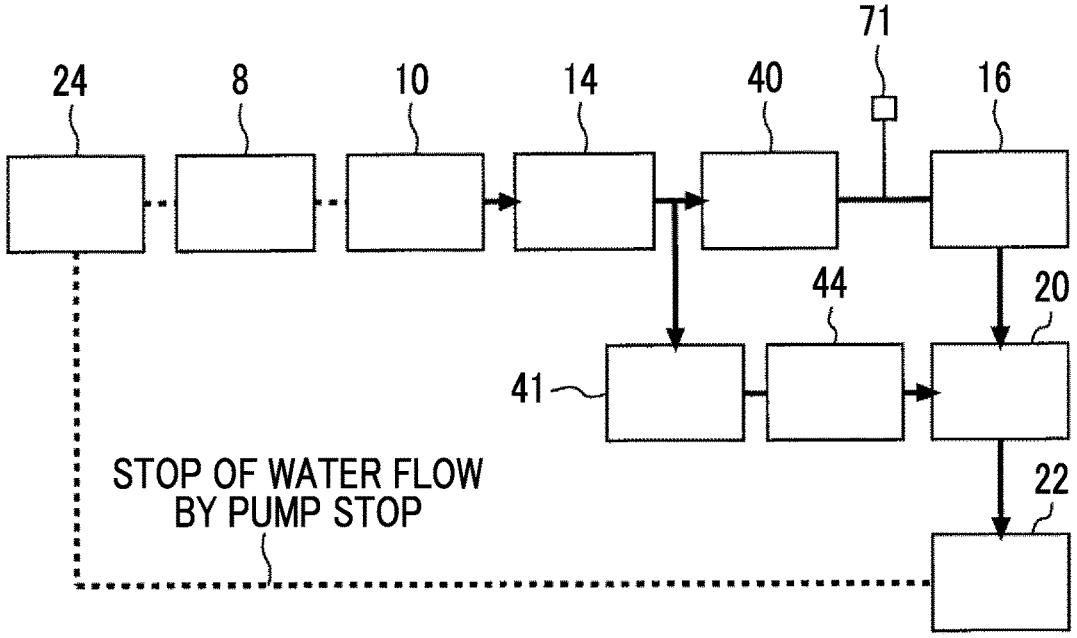
FIG. 3 is a view for describing the flow of a refrigerant flowing through a refrigerant circulation circuit during the operation of an engine.

A waste heat recovery control to be performed in the waste heat recovery apparatus 1 will be described. FIG. 3 is a view for describing the flow of the refrigerant flowing through the refrigerant circulation circuit during the operation of the engine. In FIG. 3, paths along which the refrigerant is flowing are represented by thick solid lines, and paths along which the refrigerant is not flowing are represented by thick broken lines.

The waste heat recovery apparatus 1 of Embodiment 1 recovers the waste heat during the operation of the engine 2 as the rotational energy of the turbine 18 using the Rankine cycle. The waste heat recovery control of the waste heat recovery apparatus 1 is performed by opening the turbine control valve 40 during the operation of the engine 2. Water serving as the liquid-phase refrigerant is stored in the evaporator 10. The evaporator 10 receives the waste heat of the exhaust gas of the engine 2, and boils the water. When the water boils, a part of the boiled water turns into a gas-phase refrigerant (steam). The steam generated in the evaporator 10 is introduced into the superheater 14 via the refrigerant pipe 33.

Here, when fresh water is injected into the evaporator 10 in a state where the water boils, the amount of the water of which the boiling subsides temporarily and which undergoes a phase transition to steam decreases. Thus, in the waste heat recovery control to be performed in the waste heat recovery apparatus 1 of Embodiment 1, while the engine 2 is operating, the pump 24 is controlled in a stopped state such that the water injection into the evaporator 10 is suppressed. According to such control, since the boiling of the water stored in the evaporator 10 can be continued as much as possible during the operation of the engine, it is possible to restrain the waste heat recovery efficiency from declining.

By further receiving the exhaust heat of the engine 2 in the process of passing through the superheater 14, the steam that undergoes the phase transition in the evaporator 10 becomes high-temperature and high-pressure superheated steam. The superheated steam passed through the superheater 14 is introduced into the turbine 18 via the refrigerant pipe 34 in a state where the turbine control valve 40 is opened. In the turbine 18, the introduced superheated steam is decompressed and expanded by the turbine nozzle 16, and then jetted to turbine blades. Accordingly, the heat energy of the superheated steam is taken out as the rotational motion of the turbine 18. Low-pressure steam passed through the turbine 18 is introduced into the condenser 20 via the refrigerant pipe 35. In a case where the pressure of the superheated steam detected by the pressure sensor 71 reaches an excessively high pressure, the bypass valve 41 is opened. Accordingly, the superheated steam of the refrigerant pipe 34 bypasses the turbine 18, and is decompressed by the bypass nozzle 44, and then escaped to the condenser 20. The steam introduced into the condenser 20 is cooled, turns into water, and is temporarily stored in the catch tank 22 via the refrigerant pipe 36. As such a waste heat recovery operation continues, the waste heat of the engine 2 continues and is recovered.

1-4. Water Injection Control to Evaporator 10

Figure 4:
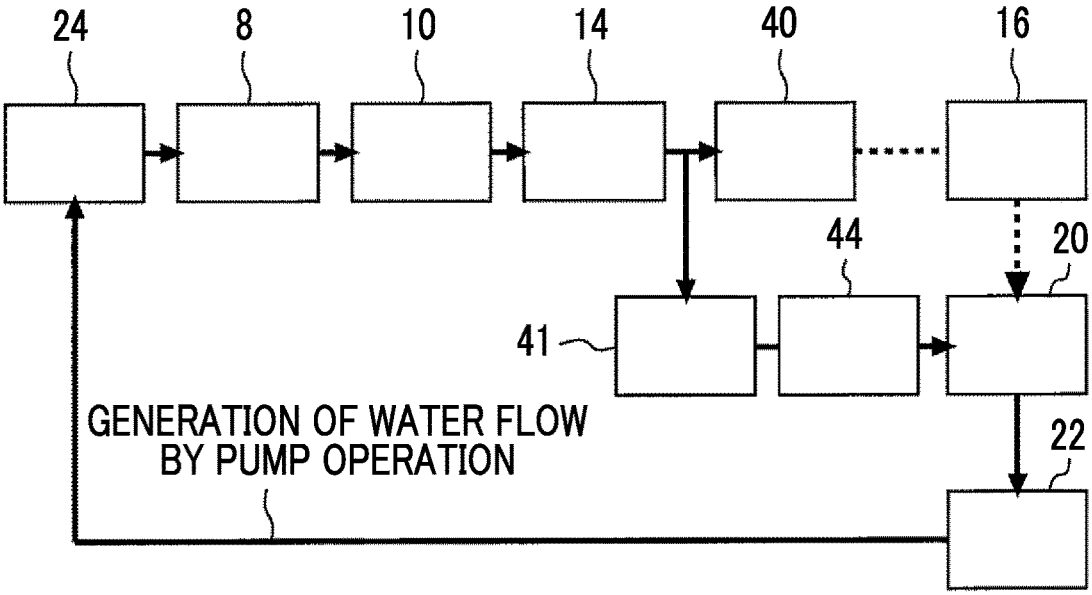
FIG. 4 is a view for describing the flow of the refrigerant flowing through the refrigerant circulation circuit during the stop of the engine.

In the waste heat recovery apparatus 1 of Embodiment 1, a water injection control of permitting water injection during the stop of the engine 2 in which the water injection into the evaporator 10 is not suppressed and supplying the water stored in the catch tank 22 to the evaporator 10 is executed. FIG. 4 is a view for describing the flow of the refrigerant flowing through the refrigerant circulation circuit during the stop of the engine. In FIG. 4, paths along which the refrigerant is flowing are represented by thick solid lines, and paths along which the refrigerant is not flowing are represented by thick broken lines.

The water injection control is performed by controlling the operation of the pump 24. The pump 24 pumps an amount of water according to its rotating speed from the refrigerant pipe 37 side to the refrigerant pipe 31 side. As illustrated in FIG. 4, when the pump 24 is operated during the stop of the engine 2, the water stored in the catch tank 22 is pumped to the engine cooling heat recovery device 8 via the refrigerant pipes 37 and 31. In the engine cooling heat recovery device 8, the engine cooling heat recovery control of heating water through the heat exchange with engine coolant is performed. The engine cooling heat recovery control will be described below in detail. The heated high-temperature water is injected into the evaporator 10 via the refrigerant pipe 32.

During the stop of the engine 2, it is desirable to close the turbine control valve 40. Accordingly, since a drop in the pressure of the superheated steam of the superheater 14 can be suppressed, the responsiveness of the waste heat recovery operation at the time of the next operation of the engine 2 can be enhanced. However, when a state where the turbine control valve 40 is closed is continued for a long time during the stop of the engine 2, the pressure of the superheater 14 may rise to an upper limit pressure determined from a viewpoint of durability or the like. Thus, in a case where the pressure of the superheater 14 reaches the upper limit pressure, it is desirable to open the bypass valve 41. Accordingly, it is possible to effectively escape the pressure of the superheater 14 to enhance the reliability of the apparatus.

1-5. Engine Cooling Heat Recovery Control Using Engine Cooling Heat Recovery Device The engine cooling heat recovery control to be performed in the engine cooling heat recovery device 8 will be described. The three-way valve 62 and the engine cooling pump 60 function as a pumping device that pumps the engine coolant to the evaporator 10. The waste heat recovery apparatus 1 of Embodiment 1 heats the water injected into the evaporator 10 by using the heat of the high-temperature engine coolant pumped to the evaporator 10 with the heat of the engine coolant, and restrains the engine coolant from boiling during the stop of the engine 2.

Figure 5:
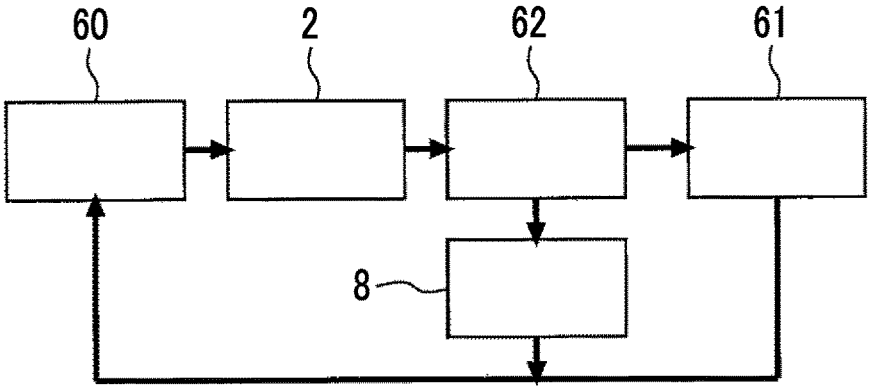
FIG. 5 is a view for describing the flow of engine coolant during the operation of the engine.
Figure 6:
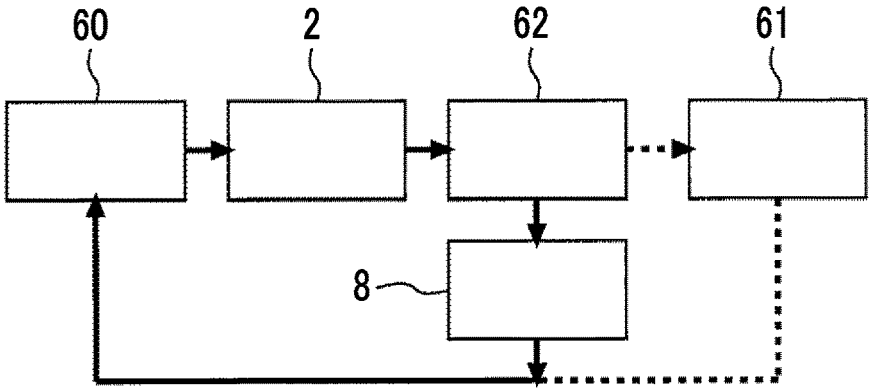
FIG. 6 is a view for describing the flow of the engine coolant during the stop of the engine.

FIG. 5 is a view for describing the flow of the engine coolant during the operation of the engine 2. FIG. 6 is a view for describing the flow of the engine coolant during the stop of the engine 2. In FIGS. 5 and 6, paths along which the engine coolant is flowing are represented by thick solid lines, and paths along which the refrigerant is not flowing are represented by thick broken lines. Hereinafter, specific processing of the engine cooling heat recovery control to be executed in the waste heat recovery apparatus of Embodiment 1 will be described, appropriately referring to FIGS. 5 and 6.

Figure 7:
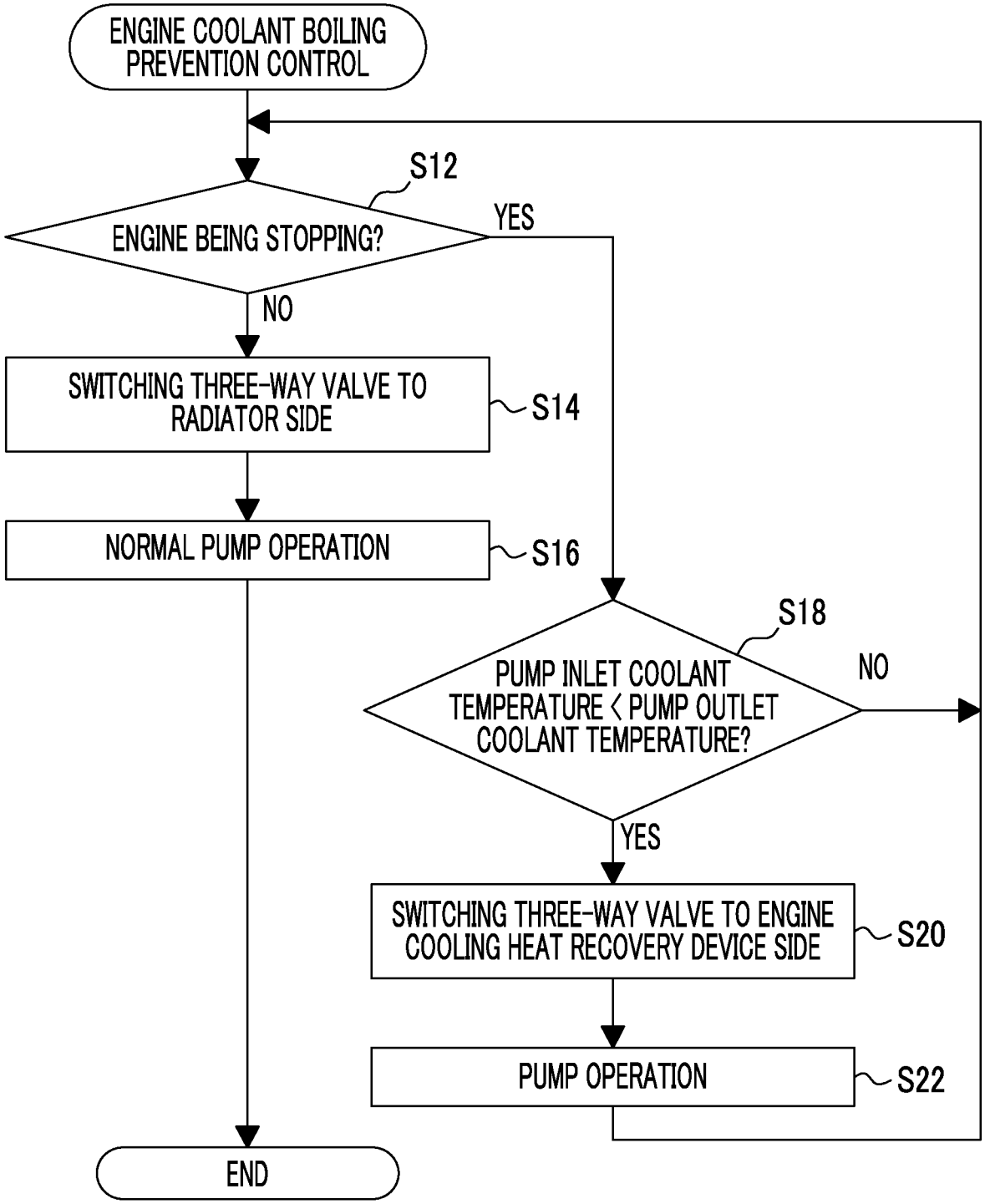
FIG. 7 is a flowchart illustrating a control routine for engine cooling heat recovery control to be executed in the waste heat recovery apparatus of Embodiment 1.

FIG. 7 is a flowchart illustrating a control routine for engine cooling heat recovery control to be executed in the waste heat recovery apparatus 1 of Embodiment 1. The control routine illustrated in FIG. 7 is repeatedly executed in each predetermined control cycle by the control device 70. In the control routine illustrated in FIG. 7, first, whether or not the engine 2 is stopping is determined (Step S12). As a result, in a case where the engine 2 is determined as being operating, the process proceeds to the next step in which a communication destination of the three-way valve 62 is switched to the fluid pipe 52 of the radiator 61 side (Step S14). Accordingly, as illustrated in FIG. 5, the engine coolant circulation circuit is formed which returns from the engine 2 to the fluid pipe 52, the three-way valve 62, the fluid pipe 52, the radiator 61, the fluid pipe 53, the engine cooling pump 60, and the fluid pipe 51, and subsequently to the engine 2.

Next, the normal operation of the pump 24 is executed (Step S16). Here, specifically, the operation of the pump 24 is controlled in accordance with the engine outlet coolant temperature detected by the temperature sensor 74. Accordingly, the waste heat carried out from the engine body during the operation of the engine 2 is carried to the radiator 61 by the engine coolant, and radiates heat through the heat exchange with external air.

On the other hand, in a case where the engine 2 is determined as being stopping in Step S12, the process proceeds to the next step in which whether or not the engine outlet coolant temperature detected by the temperature sensor 74 is higher than the pump inlet coolant temperature detected by the temperature sensor 73 is determined (Step S18). As a result, in a case where Engine outlet coolant temperature>Pump inlet coolant temperature is not satisfied, the water passing through the engine cooling heat recovery device 8 is determined as being incapable of being heated through the heat exchange with engine coolant, and the process returns to the processing of Step S12 again.

On the other hand, in the processing of Step S18, in a case where Engine outlet coolant temperature>Pump inlet coolant temperature is satisfied, the water passing through the engine cooling heat recovery device 8 is determined as being capable of being heated through the heat exchange with the engine coolant, and the engine coolant is determined as having a possibility of boiling. In this case, the process proceeds to the next step in which the communication destination of the three-way valve 62 is switched to the fluid pipe 54 on the engine cooling heat recovery device 8 side (Step S20). Accordingly, as illustrated in FIG. 6, the circulation circuit is formed which returns from the engine 2 to the fluid pipe 52, the three-way valve 62, the fluid pipe 54, the engine cooling heat recovery device 8, the fluid pipe 55, the fluid pipe 53, the engine cooling pump 60, and the fluid pipe 51, and subsequently to the engine 2.

The engine cooling pump 60 is operated (Step S22). Accordingly, the waste heat carried out from the engine body during the stop of the engine 2 is carried to the engine cooling heat recovery device 8 by the engine coolant. During the stop of the engine 2, the pump 24 is operated, and thereby the water that is the refrigerant is carried to the evaporator 10 via the engine cooling heat recovery device 8. In the engine cooling heat recovery device 8, the waste heat of the engine coolant is transferred to the water. The water of which the temperature rises due to the absorption of the heat is injected into the evaporator 10 via the refrigerant pipe 32. The engine coolant of the temperature drops due to heat dissipation is returned to the body of the engine 2 through the fluid pipe 55, the fluid pipe 53, and the fluid pipe 51. When the processing of Step S22 is executed, the process returns to the processing of Step S12 again.

According to such an engine cooling heat recovery control, the engine coolant can be restrained from boiling during the stop of the engine 2. Since the waste heat of the engine coolant is transferred to the water that is the refrigerant, it is possible to further enhance the waste heat recovery efficiency.

A configuration in which a small amount of engine coolant is made to flow to the engine cooling heat recovery device 8 side during the operation of the engine 2 may be adopted. Such a control can be realized, for example, by the control of intermittently switching the three-way valve 62 to the engine cooling heat recovery device 8 side during the operation of the engine 2, the control of adjusting an opening degree on the radiator 61 side and an opening degree on the engine cooling heat recovery device 8 side by using a control valve capable of adjusting the opening degree. Accordingly, since the temperature of the engine cooling heat recovery device 8 is restrained from dropping markedly during the operation of the engine 2, it is possible to enhance the waste heat recovery efficiency during the stop of the engine 2.

1-6. Specific Processing Executed in Waste Heat Recovery Apparatus

Figure 8:
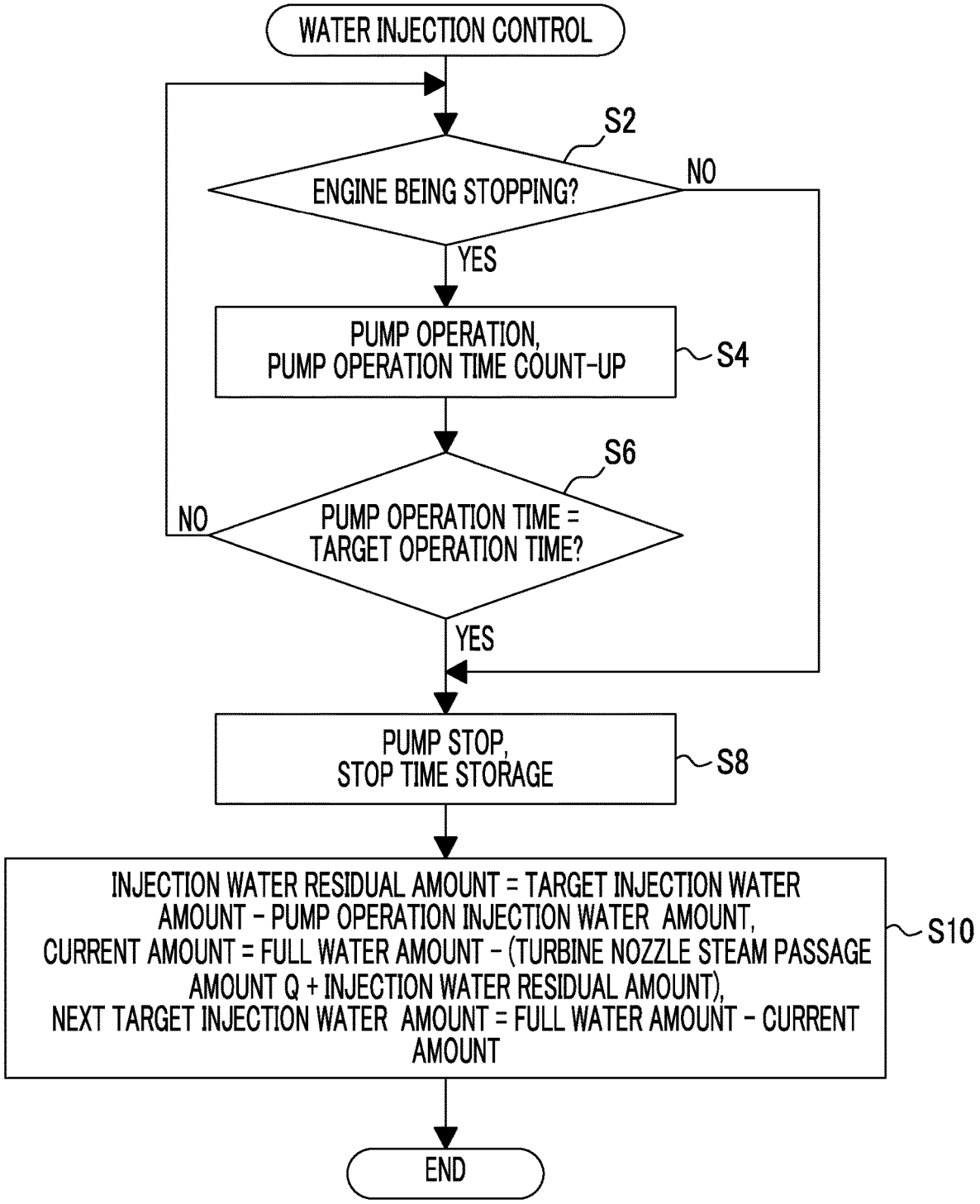
FIG. 8 is a flowchart illustrating a control routine for water injection control to be executed in the waste heat recovery apparatus of Embodiment 1.

Specific processing of the water injection control to be executed in the waste heat recovery apparatus 1 of Embodiment 1 will be described. FIG. 8 is a flowchart illustrating a control routine for the water injection control to be executed in the waste heat recovery apparatus 1 of Embodiment 1. The control routine illustrated in FIG. 8 is repeatedly executed in each predetermined control cycle by the control device 70.

In the control routine illustrated in FIG. 8, first, whether or not the engine 2 is stopping is determined (Step S2). As a result, in a case where the engine 2 is determined as being operating, the water injection into the evaporator 10 is determined as being suppressed, and the process proceeds to Step S8 to be described below. On the other hand, in a case where the engine 2 is determined as being stopping, the water injection into the evaporator 10 is determined as being permitted, and the process proceeds to the next step in which the pump 24 is operated, and the integrated time (hereinafter, pump operating time) after the pump is operated is calculated (Step S4).

Whether or not the pump operating time calculated in Step S4 reaches target operating time is determined (Step S6). The target operating time is the operating time of the pump 24 needed to inject water with the next target injection water amount calculated in Step S10 of the previous control routine. As a result, in a case where the pump operating time does not reach target operating time, the process returns to the processing of Step S2 again.

On the other hand, in a case where the pump operating time reaches the target operating time in Step S6, the injection of the target injection water amount is determined as being completed, and the process proceeds to the next step in which the operation of the pump 24 is stopped and the pump operating time (hereinafter, stop time) until the operation is stopped is stored (Step S8).

When the processing of Step S8 is executed, the target injection water amount at the time of the next water injection (target refrigerant amount) is calculated (Step S10). Here, first, the injection water residual amount in the current control routine is calculated using the following Equation (1). The pump operation injection water amount of the following Equation (1) is the amount of water into injected in the current control routine, and can be calculated by multiplying injection water amount per unit time calculated from the rotating speed of the pump 24 by the stop time stored in Step S8. A pressure difference between the nozzle pre-pressure detected in the pressure sensor 71 and the nozzle post-pressure detected by the pressure sensor 76 is equivalent to a difference between pressures in front of and behind the pump 24. Thus, it is preferable to store, on a map or the like, a relationship between the pressure difference and the leak amount of water that leaks from the front of the pump 24 to a position behind the pump in advance, and to specify a water leak amount corresponding to the detected pressure difference to correct the pump operation injection water amount.

$$\text{Injection water residual amount} = \text{Target injection water amount} - \text{Pump operation injection water amount} \quad (1)$$

The current amount of the water stored in the evaporator 10 is calculated using the following Equation (2). In the following Equation (2), full water amount represents water maximum amount capable of being stored in the evaporator 10. The current amount is the current amount of the water stored in the evaporator 10.

$$\text{Current amount} = \text{Full water amount} - (\text{Turbine nozzle steam passage amount } Q + \text{Injection water residual amount}) \quad (2)$$

The turbine nozzle stream passage amount Q of the above Equation (2) can be calculated using the following Equation (3) using the nozzle pre-pressure P and the nozzle pre-temperature T. In the following Equation (3), A represents the opening area of the nozzle, R represents a steam gas constant, and κ represents the specific heat ratio of steam. Then, the target injection water amount at the time of the next water injection is calculated using the following Equation (4). When the processing of Step S10 is executed, the main control routine is ended.

$$Q = A\sqrt{\kappa\left(\frac{2}{\kappa+1}\right)} \times \frac{p}{\sqrt{RT}} \tag{3}$$

$$\text{Next target injection water amount} = \text{Full amount} - \text{Current amount} \tag{4}$$

1-7. Specific Example of Water Injection Control

Figure 9:
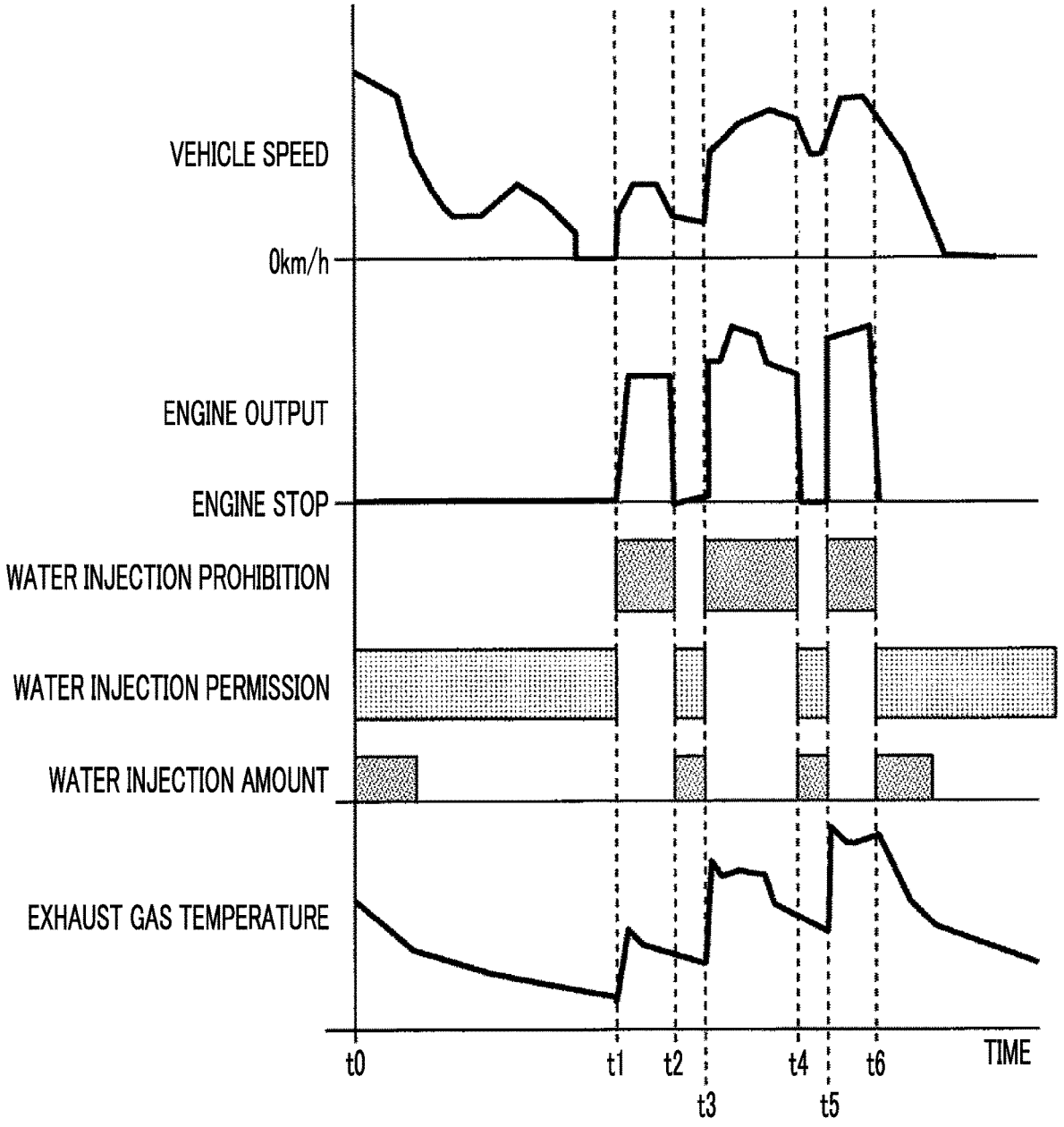
FIG. 9 is a time chart illustrating various state quantities during the traveling of a vehicle on which the waste heat recovery apparatus is mounted.

An example of the water injection control to be performed in a case where the vehicle on which the waste heat recovery apparatus 1 of Embodiment 1 is mounted is made to actually travel will be described with reference to FIG. 9. FIG. 9 is a time chart illustrating various state quantities during the traveling of the vehicle on which the waste heat recovery apparatus is mounted. Since the engine 2 is stopping in a period from time t0 to time t1 illustrated on the chart of FIG. 9, the injection of the water, which is the refrigerant, into the evaporator 10 is permitted. For this reason, in the example illustrated on the chart of FIG. 9, the water injection into the evaporator 10 from time t0 is performed. When the refrigerant stored in the evaporator 10 in the period during which the injection of the refrigerant is permitted has the full water amount, the pump 24 is stopped. When the water injection is performed on the evaporator 10 and the boiling of the water subsides temporarily, the latent heat for evaporation of the water is no longer used. Therefore, there is also an advantage that a drop in the exhaust gas temperature during the stop of the engine 2 is suppressed.

When the engine 2 is operated at time t1, the recovery of waste heat is performed by the Rankine cycle upon receiving a rise in the exhaust gas temperature. Since the water injection is suppressed in a period from time t1 to time t2 during which the engine 2 is stopped, the pump 24 is maintained in a stopped state.

When the engine 2 is again stopped at time t2, the water injection is permitted again. In a case where the water stored in the evaporator 10 does not reach the full amount, the pump 24 is operated again in this period. Hereinafter, similarly, the water injection is suppressed in a period from time t3 to time t4 during which the engine 2 is operated, the water injection is permitted in a period from time t4 to time t5 during which the engine is stopped, and then, the water injection is permitted again when the engine 2 is operated again at time t5.

In this way, according to the waste heat recovery apparatus 1 of Embodiment 1, the water injection into the evaporator 10 is not performed during the operation of the engine 2, and the water injection is performed using the period during which the engine 2 stops. Accordingly, it is possible to continue the boiling of the evaporator 10 during the operation of the engine 2 to enhance the waste heat recovery efficiency.

Meanwhile, in the waste heat recovery apparatus 1 of the above-described Embodiment 1, the evaporator 10 including the bellows tube 104 is used. However, the configuration of an available evaporator 10 is not limited to this. That is, as long as the evaporator 10 can withstand the temperature (for example, 400° C.) of the exhaust gas introduced thereinto, other well-known structures may be adopted. In addition, in the waste heat recovery apparatus 1 of Embodiment 1, the amount of the water stored in the evaporator 10 is not detected or estimated. For this reason, during the operation of the engine 2, the water injection into the evaporator 10 is not performed even when the actual amount of the water within the evaporator 10 becomes equal to or lower than a predetermined low refrigerant amount (for example, zero). The configuration of the above-described evaporator 10 is a configuration in which such a no-water burning situation of the evaporator 10 is assumed, and accordingly, it is possible to ensure the long-term reliability of the evaporator 10.

Although the waste heat recovery apparatus 1 of above-described Embodiment 1 includes the superheater 14, the above configuration is not indispensable.

Although the waste heat recovery apparatus 1 of the above-described Embodiment 1 includes the engine cooling heat recovery device 8 that performs the heat exchange with the engine coolant, the above configuration is not indispensable. In the configuration of the engine cooling heat recovery device 8, for example, a heat recovery device that performs the heat exchange with the exhaust gas may be adopted as the heat recovery device using the waste heat of the engine 2.

The waste heat recovery apparatus 1 of the above-described Embodiment 1 has a configuration in which the water injection into the evaporator 10 is stopped by controlling the pump 24 into a stopped state. However, means for stopping the water injection into the evaporator 10 is not limited to this. For example, in the waste heat recovery apparatus 1 further including a bypass pipe that branches from the refrigerant pipe 31 and is connected to the catch tank 22, and a switching valve provided in a branching part between the refrigerant pipe 31 and the bypass pipe, the switching valve may be controlled to open the bypass pipe side in a state where the pump 24 is operated. According to such control, it is also possible to stop the water injection into the evaporator 10 in a state where the pump 24 is operated.

Embodiment 2

A waste heat recovery apparatus of Embodiment 2 will be described. The waste heat recovery apparatus 1 of Embodiment 2 can be realized by causing the control device 70 to execute a control routine illustrated in FIG. 10 (to be described below) using the hardware configuration illustrated in FIG. 1.

2-1. Feature of Waste Heat Recovery Apparatus of Embodiment 2

In the waste heat recovery apparatus 1 of above-described Embodiment 1, the water injection control during the operation of the engine 2 is uniformly suppressed, and the pump 24 is brought into a stopped state. However, in the water injection control of Embodiment 1, is assumed that the water stored in the evaporator 10 runs out in a case where the operation of the engine 2 is continued for a long time.

Thus, the waste heat recovery apparatus 1 of Embodiment 2 has a feature in the control of executing the water injection control, in a case where all the water stored in the evaporator 10 during the operation of the engine 2 is turned into steam. Hereinafter, specific processing of the water injection control to be executed by Embodiment 2 will be described in accordance with a flowchart.

2-2. Specific Processing Executed in Waste Heat Recovery Apparatus

Figure 10:
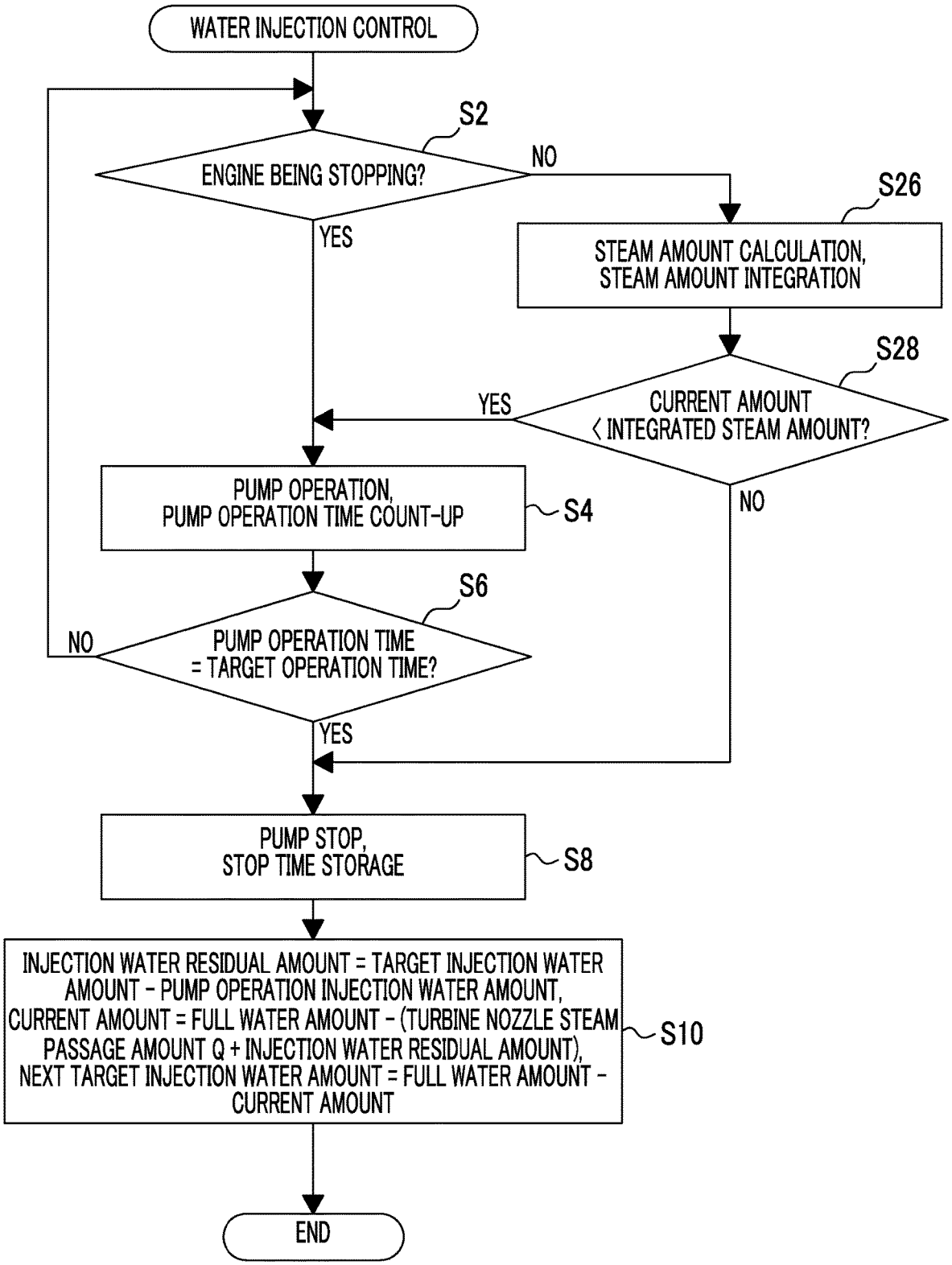
FIG. 10 is a flowchart illustrating a control routine for water injection control to be executed in a waste heat recovery apparatus of Embodiment 2.

FIG. 10 is a flowchart illustrating a control routine for the water injection control to be executed in the waste heat recovery apparatus 1 of Embodiment 1. The control routine illustrated in FIG. 10 is repeatedly executed in each predetermined control cycle by the control device 70.

In Steps S2 to S10 in the control routine illustrated in FIG. 10, the same processing as the processing of Steps S2 to S10 of the above-described control routine of FIG. 8 is basically performed. However, in the control routine illustrated in FIG. 10, in a case where the engine 2 is determined as being operating as a result of the processing of Step S2, the process proceeds to a separate step in which an integrated value (hereinafter, integrated steam amount) in the current control routine for the amount of the steam that undergoes the phase transition in the evaporator 10 is calculated (Step S26). Here, specifically, the turbine nozzle stream passage amount Q is calculated using Equation (3). Then, the integrated steam amount is calculated by integrating the turbine nozzle stream passage amount Q calculated in the current control routine.

Whether or not the integrated steam amount is larger than the current amount calculated in the previous control routine is determined (Step S28). As a result, in a case where Current amount<Integrated steam amount is satisfied, the total amount of water stored in the evaporator 10 can be determined as having undergone phase transition into steam. In this case, the process proceeds to Step S4 in which the water injection into the evaporator 10 is performed. On the other hand, in Step S28, in a case where Current amount<Integrated steam amount is not satisfied, residual water can be determined as being present in the evaporator 10. In this case, the process proceeds to Step S8 in which the pump 24 is brought into a stopped state.

In this way, in the waste heat recovery apparatus 1 of Embodiment 2, the water injection is performed in a case where the water stored in the evaporator 10 runs out during the operation of the engine 2. Accordingly, since the water injection can be performed without waiting for the next stop of the engine 2, the waste heat recovery efficiency can be enhanced. Since the evaporator 10 can be restrained from undergoing the no-water burning, it is possible to protect the evaporator 10 from heat. In the waste heat recovery apparatus 1 of Embodiment 2, during the operation of the engine 2, the water injection is not performed until the water stored in the evaporator 10 runs out. Accordingly, since the boiling state of the water of the evaporator 10 can be continued and the water can be run out, it is possible to enhance the waste heat recovery efficiency as compared to a case where the water injection is performed on the way and the boiling subsides.

Meanwhile, in the waste heat recovery apparatus 1 of the above-described Embodiment 2, the control in which the water injection is performed in a case where the total amount of water stored in the evaporator 10 undergoes phase transition into steam during the operation of the engine 2 is adopted. However, the timing at which the water injection is performed is not limited to the above timing. That is, when the water stored in the evaporator 10 decreases, the contact area between the water and a heat exchanger decreases. Therefore, heat exchange capacity declines. Thus, the amount of the refrigerant in which the heat exchanger is exposed and the heat exchange capacity declines significantly may be set in advance as the low refrigerant amount, and the water injection may be performed in a case where the amount of the water stored in the evaporator 10 decreases to the low refrigerant amount. In such control, satisfaction of Current amount—Low refrigerant amount<Integrated steam amount may be determined, for example, in Step S26 of the control routine illustrated in the FIG. 10. Accordingly, it is possible to enhance efficiency quickly in a case where the waste heat recovery efficiency declines.

Embodiment 3

A waste heat recovery apparatus of Embodiment 3 will be described. The waste heat recovery apparatus 1 of Embodiment 3 can be realized by causing the control device 70 to execute a control routine illustrated in FIG. 11 (to be described below) using the hardware configuration illustrated in FIG. 1.

3-1. Feature of Waste Heat Recovery Apparatus of Embodiment 3

In the waste heat recovery apparatus 1 of the above-described Embodiment 1, whether or not the water injection is executed is determined depending on whether or not the engine 2 is stopping. However, since the heat energy obtained from the exhaust gas is small depending on the operation conditions of the engine 2, a situation where the temperature of the water stored in the evaporator 10 does not reach the boiling point is also considered. In this case, when the water injection into the evaporator 10 is performed, the temperature of the water stored in the evaporator 10 will drop further, and the time needed for the water to boil will be prolonged. Such a situation is assumed, for example, in a case where the short-time operation of the engine 2 is repeated, in a case where the low-load operation of the engine 2 is continued for a long time, or the like.

Thus, the waste heat recovery apparatus 1 of Embodiment 3 has a feature in the control of prohibiting the execution of the water injection control, in a case where the temperature of the water stored in the evaporator 10 does not reach a boiling temperature. Hereinafter, specific processing of the water injection control to be executed by Embodiment 3 will be described in accordance with a flowchart.

3-2. Specific Processing Executed in Waste Heat Recovery Apparatus

Figure 11:
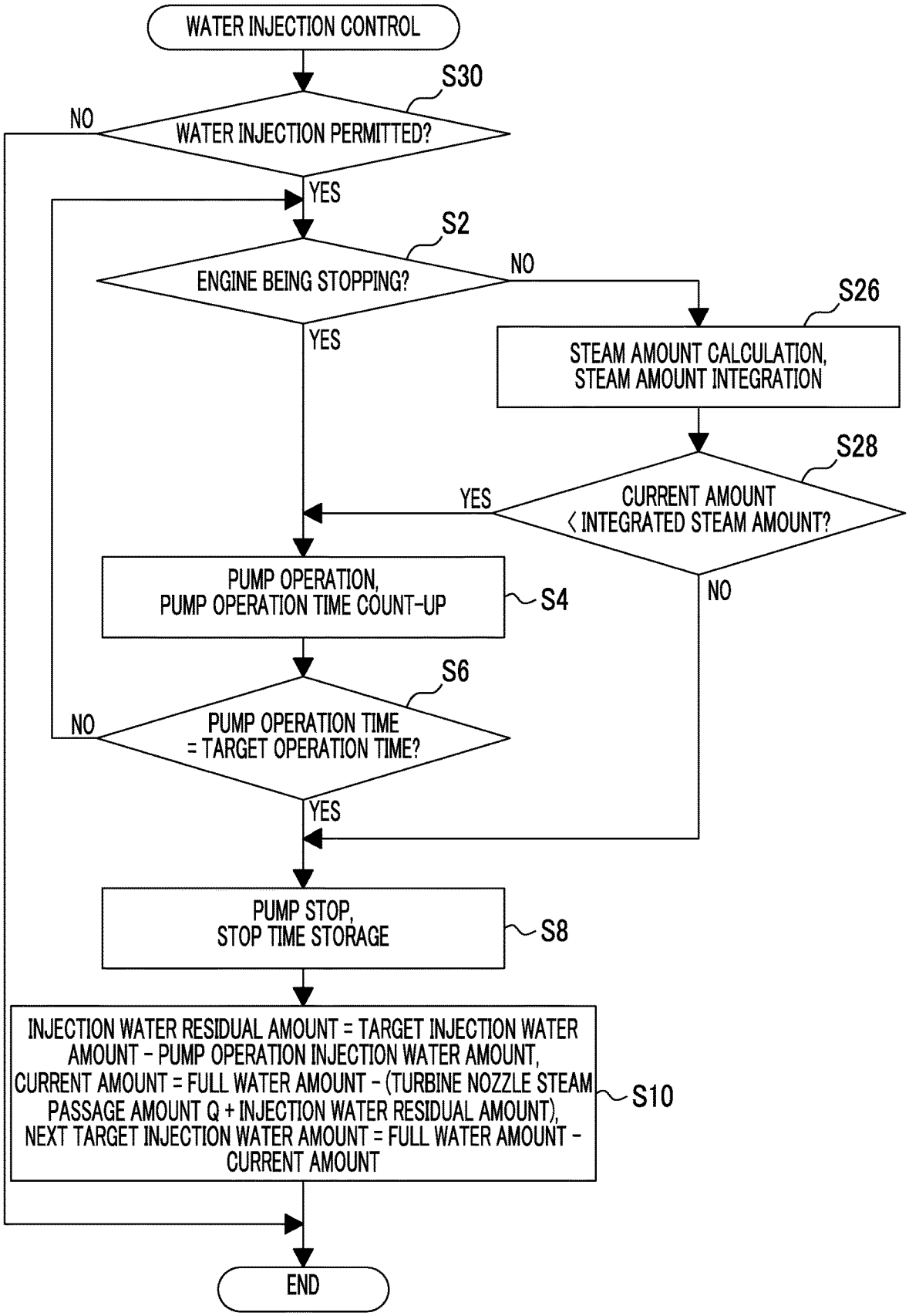
FIG. 11 is a flowchart illustrating a control routine for water injection control to be executed in a waste heat recovery apparatus of Embodiment 3.

FIG. 11 is a flowchart illustrating a control routine for the water injection control to be executed in the waste heat recovery apparatus 3 of Embodiment 1. The control routine illustrated in FIG. 11 is repeatedly executed in each predetermined control cycle by the control device 70.

In the control routine illustrated in FIG. 11, first, whether or not the water injection is permitted is determined (Step S30). Here, specifically, whether or not a coolant temperature detected by the temperature sensor 75 provided in the evaporator 10 is equal to or higher than the boiling temperature (for example, 100° C.) is determined. As a result, in a case where Coolant temperature Boiling temperature is not satisfied, the time needed up to re-boiling is determined to be prolonged due to the water injection, and the control routine illustrated in FIG. 11 is ended. On the other hand, in Step S30, in a case where Coolant temperature Boiling temperature is satisfied, the water within the evaporator 10 is already in a boiling state. Therefore, the time needed up to re-boiling is determined not to be excessively prolonged due to the water injection. In this case, the process proceeds to the processing after the next Step S2 in which the same processing as the processing in the control routine illustrated in FIG. 10 is performed.

In this way, in the waste heat recovery apparatus 1 of Embodiment 3, the water injection in a case where the water stored in the evaporator 10 does not reach the boiling temperature is suppressed. Accordingly, the waste heat recovery efficiency can be enhanced by restraining the time needed for the water stored in the evaporator 10 to re-boil from being excessively prolonged.

Meanwhile, the waste heat recovery apparatus 1 of the above-described embodiment 3 has a configuration in which whether or not the water injection is possible depending on whether or not the temperature of the water stored in the evaporator 10 is equal to or higher than the boiling temperature is determined. However, since the boiling temperature is a value that varies depending on pressure, the pressure inside the evaporator 10 may be detected to correct the boiling temperature. Accordingly, it is possible to accurately determine whether or not the water stored in the evaporator 10 boils.

In the waste heat recovery apparatus 1 of the above-described embodiment 3, whether or not the temperature of the water stored in the evaporator 10 is equal to or higher than the boiling temperature is determined using the temperature sensor 75. However, the method of determining the temperature state of the water stored in the evaporator 10 is not limited to the above. That is, for example, when the difference between temperatures in front of and behind the evaporator 10 and intake air amount is detected, the quantity of heat received by the water in the evaporator 10 can be estimated. Thus, the temperature state of the water stored in the evaporator 10 may be estimated with the quantity of heat as an index. The temperature state of the water stored in the evaporator 10 may be estimated with the active state of the exhaust gas control catalyst 12 as an index.

What is claimed is:

1. A waste heat recovery apparatus comprising:

an evaporator configured to turn a liquid-phase refrigerant into steam through heat exchange with exhaust gas of an internal combustion engine;

an expander configured to expand a gas-phase refrigerant passed through the evaporator to recover heat energy;

a condenser configured to condense the gas-phase refrigerant passed through the expander such that the gas-phase refrigerant returns to the liquid-phase refrigerant;

a liquid-phase refrigerant supply device, that is a first pump, configured to supply the liquid-phase refrigerant delivered from the condenser, to the evaporator; and a control device, comprising a processor, configured to control the liquid-phase refrigerant supply device so as to adjust an amount of the liquid-phase refrigerant to be supplied to the evaporator, wherein the control device is configured to start supply of the liquid-phase refrigerant by the liquid-phase refrigerant supply device based on the internal combustion engine, that operates while the supply of the liquid-phase refrigerant by the liquid-phase refrigerant supply device is in a continued stopped state, being stopped.

2. The waste heat recovery apparatus according to claim 1, wherein:

the liquid-phase refrigerant supply device, that is the first pump, pumps the liquid-phase refrigerant delivered from the condenser to the evaporator; and the control device is configured to stop the supply of the liquid-phase refrigerant by stopping operation of the first pump.

3. The waste heat recovery apparatus according to claim 2, wherein the control device is configured to continue a state where the operation of the first pump is stopped, during operation of the internal combustion engine and even after the amount of the liquid-phase refrigerant stored in the evaporator becomes equal to or lower than a predetermined amount.

4. The waste heat recovery apparatus according to claim 2, wherein the control device is configured to operate the first pump based on and during the operation of the internal combustion engine in a case where the amount of the liquid-phase refrigerant stored in the evaporator becomes equal to or lower than a predetermined amount.

5. The waste heat recovery apparatus according to claim 2, wherein:

the control device is configured to operate the first pump based on and during stop of the internal combustion engine in a case where a temperature of the liquid-phase refrigerant stored in the evaporator reaches a boiling temperature; and the control device is configured to bring the first pump into a stopped state based on and during the stop of the internal combustion engine when the temperature of the liquid-phase refrigerant stored in the evaporator does not reach the boiling temperature.

6. A waste heat recovery apparatus comprising:

an evaporator configured to turn a liquid-phase refrigerant into steam through heat exchange with exhaust gas of an internal combustion engine;

an expander configured to expand a gas-phase refrigerant passed through the evaporator to recover heat energy;

a condenser configured to condense the gas-phase refrigerant passed through the expander such that the gas-phase refrigerant returns to the liquid-phase refrigerant;

a liquid-phase refrigerant supply device, that is a first pump, configured to supply the liquid-phase refrigerant delivered from the condenser, to the evaporator; and a control device, comprising a processor, configured to control the liquid-phase refrigerant supply device so as to adjust an amount of the liquid-phase refrigerant to be supplied to the evaporator, wherein the liquid-phase refrigerant supply device, that is the first pump, pumps the liquid-phase refrigerant delivered from the condenser to the evaporator;

the control device is configured to stop supply of the liquid-phase refrigerant by stopping operation of the first pump;

the control device is configured to operate the first pump during operation of the internal combustion engine and in a case where the amount of the liquid-phase refrigerant stored in the evaporator becomes equal to or lower than a predetermined amount;

the control device is configured to calculate an amount of a refrigerant needed to bring the amount of the liquid-phase refrigerant stored in the evaporator into a full amount as a target refrigerant amount; and the control device is configured to control the operation of the first pump with the target refrigerant amount as an upper limit.

7. A waste heat recovery apparatus comprising:

an evaporator configured to turn a liquid-phase refrigerant into steam through heat exchange with exhaust gas of an internal combustion engine;

an expander configured to expand a gas-phase refrigerant passed through the evaporator to recover heat energy;

a condenser configured to condense the gas-phase refrigerant passed through the expander such that the gas-phase refrigerant returns to the liquid-phase refrigerant;

a liquid-phase refrigerant supply device, that is a first pump, configured to supply the liquid-phase refrigerant delivered from the condenser, to the evaporator;

a control device, comprising a processor, configured to control the liquid-phase refrigerant supply device so as to adjust an amount of the liquid-phase refrigerant to be supplied to the evaporator;

a heat exchanger that performs heat exchange between the liquid-phase refrigerant passed through the first pump, and an engine coolant passed through the internal combustion engine; and a second pump that pumps the engine coolant to the heat exchanger, wherein the liquid-phase refrigerant supply device, that is the first pump, pumps the liquid-phase refrigerant delivered from the condenser to the evaporator;

the control device is configured to stop supply of the liquid-phase refrigerant by stopping operation of the first pump; and the control device is configured to operate the second pump in a case where the first pump is operated and in a case where a temperature of the engine coolant is higher than a temperature of the liquid-phase refrigerant passed through the first pump.

8. The waste heat recovery apparatus according to claim 1, wherein:

the evaporator includes a flue tube through which the exhaust gas of the internal combustion engine flows and a refrigerant passage which is formed around the flue tube and in which the liquid-phase refrigerant is stored;

a first end of the flue tube is constituted as a fixed end; and a second end of the flue tube includes a bellows tube for absorbing a change in tube length resulting from thermal expansion of the flue tube.

9. A method for controlling a waste heat recovery apparatus including an evaporator, an expander, a condenser, and a liquid-phase refrigerant supply device that is a first pump, the evaporator being configured to turn a liquid-phase refrigerant into steam through heat exchange with exhaust gas of an internal combustion engine, the expander being configured to expand a gas-phase refrigerant passed through the evaporator to recover heat energy, the condenser being configured to condense the gas-phase refrigerant passed through the expander to return the condensed gas-phase refrigerant to the liquid-phase refrigerant, and the liquid-phase refrigerant supply device being configured to supply the liquid-phase refrigerant delivered from the condenser, to the evaporator, the method comprising:

adjusting an amount of the liquid-phase refrigerant to be supplied to the evaporator by controlling the liquid-phase refrigerant supply device;

starting supply of the liquid-phase refrigerant by the liquid-phase refrigerant supply device based on the internal combustion engine, that operates while the supply of the liquid-phase refrigerant by the liquid-phase refrigerant supply device is in a continued stopped state, being stopped.

* * * * *